US008486232B2

(12) United States Patent
Knoch

(10) Patent No.: US 8,486,232 B2
(45) Date of Patent: Jul. 16, 2013

(54) CLEANING DEVICE FOR THE FRAME OF A COKE OVEN RETORT

(75) Inventor: Ralf Knoch, Gelsenkirchen (DE)

(73) Assignee: ThyssenKrupp Uhde GmbH, Dortmund (DE)

( * ) Notice: Subject to any disclaimer, the term of this patent is extended or adjusted under 35 U.S.C. 154(b) by 736 days.

(21) Appl. No.: 12/733,857

(22) PCT Filed: Sep. 5, 2008

(86) PCT No.: PCT/EP2008/007268

§ 371 (c)(1),
(2), (4) Date: Mar. 24, 2010

(87) PCT Pub. No.: WO2009/043422

PCT Pub. Date: Apr. 9, 2009

(65) Prior Publication Data

US 2010/0206710 A1 Aug. 19, 2010

(30) Foreign Application Priority Data

Sep. 29, 2007 (DE) ..... 10 2007 046 804

(51) Int. Cl.
*C10B 55/02* (2006.01)

(52) U.S. Cl.
USPC ..... 202/241; 134/24; 134/42; 202/270

(58) Field of Classification Search
USPC ..... 202/241, 270; 134/24, 42
See application file for complete search history.

(56) References Cited

U.S. PATENT DOCUMENTS

| | | | | | |
|---|---|---|---|---|---|
| 4,025,979 | A | * | 5/1977 | Stanke et al. | 15/93.2 |
| 4,515,660 | A | * | 5/1985 | Kwasnik et al. | 202/241 |
| RE34,436 | E | * | 11/1993 | Baird et al. | 202/241 |
| 5,934,848 | A | * | 8/1999 | Hamalainen | 409/178 |
| 7,077,618 | B2 | | 7/2006 | Knoch | |

FOREIGN PATENT DOCUMENTS

| | | |
|---|---|---|
| JP | 11-236571 | 8/1999 |
| WO | WO 02/077122 | 10/2002 |
| WO | WO 2007/025638 | 3/2007 |

* cited by examiner

*Primary Examiner* — Nina Bhat
(74) *Attorney, Agent, or Firm* — Collard & Roe, P.C.

(57) ABSTRACT

A cleaning device for the frame of a coke oven retort has a tool carrier positioned between anchor stands of the coke oven retort and exhibits cleaning apparatuses for the frame of the coke oven retort, sheet-shaped sealing elements being arranged on the tool carrier. The sealing elements are secured to the reverse side of the tool carrier, which side faces away from the coke oven retort. The sealing elements are orientated vertically and completely cover the height of the reverse side. The sealing elements consist of at least one central piece which is immovably fixed to the tool carrier and of side wings, the side wings being connected with the central piece in such a manner as to be rotationally moveable on vertical axes. The side wings are moveable in an adjusting movement in the direction of the coke oven retort against the front surfaces of the anchor stands.

9 Claims, 1 Drawing Sheet

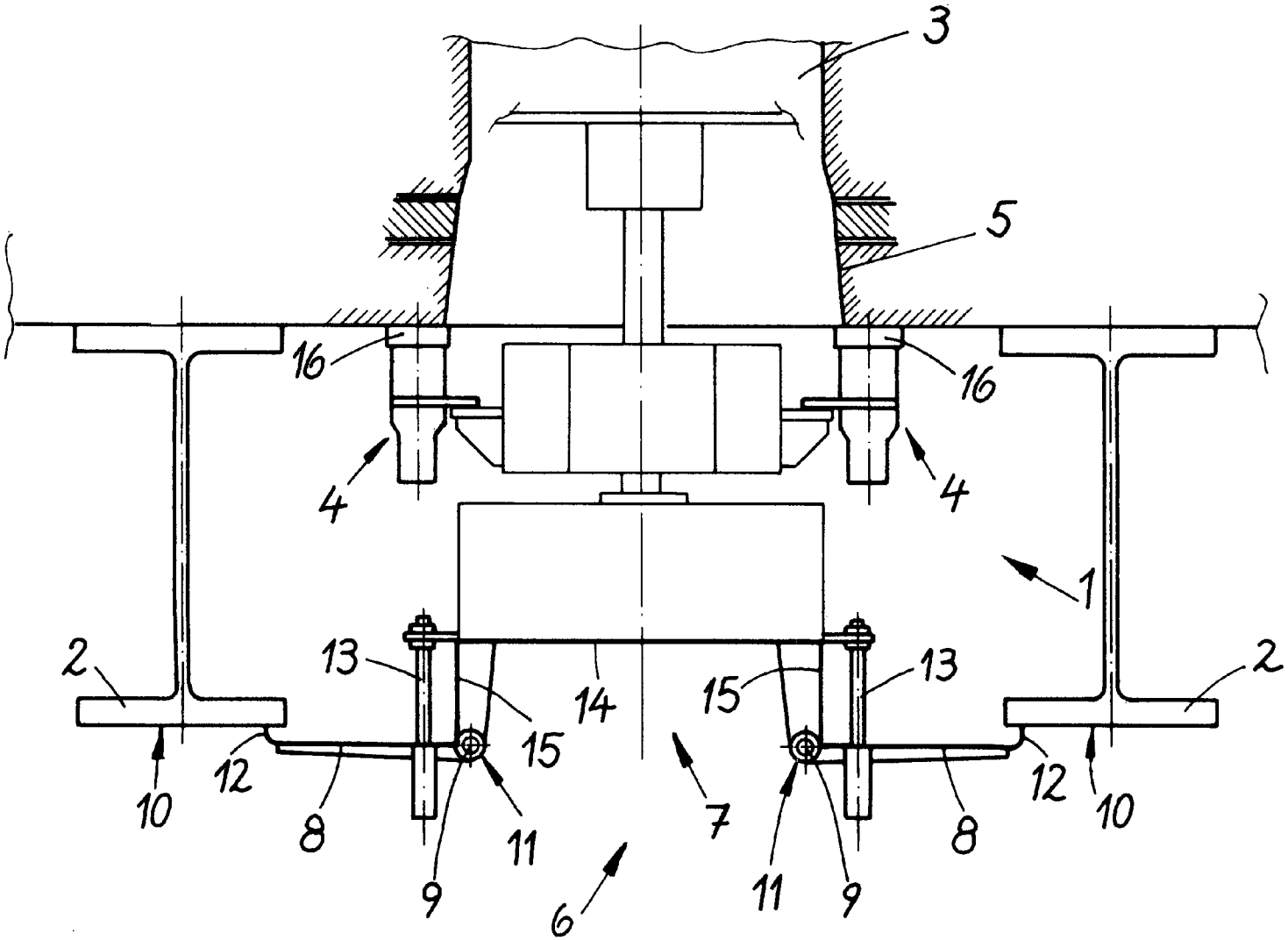
1
2
2
3
4
4
5
6
7
8
8
9
9
10
10
11
11
12
12
13
13
14
15
15
16
16

CLEANING DEVICE FOR THE FRAME OF A COKE OVEN RETORT

CROSS REFERENCE TO RELATED APPLICATIONS

This application is the National Stage of PCT/EP2008/007268 filed on Sep. 5, 2008, which claims priority under 35 U.S.C. §119 of German Application No. 10 2007 046 804.2 filed on Sep. 29, 2007. The international application under PCT article 21(2) was not published in English.

BACKGROUND OF THE INVENTION

1. Field of the Invention

The invention relates to a cleaning device for the frame of a coke oven retort with a tool carrier which can be positioned between anchor stands of the coke oven retort and exhibits cleaning apparatuses for the frame of the coke oven retort, sheet-shaped sealing elements being arranged on the tool carrier.

2. Description of the Related Art

In a modern coking plant, the frames of the coke oven retorts are usually cleaned by cleaning devices after the prepared coke has been ejected from the coke oven retorts, in order to guarantee a gas-tight sealing of the coke oven retort. In such a case, the cleaning devices are arranged on the coke oven operating machines. Emissions arise when cleaning a coke oven retort frame, which emissions represent a hazard for the operating personnel of the coke oven battery and must therefore be extracted. However, as horizontal air movements along the master gangways or through open coke oven retorts cannot be avoided when operating the coke oven, the emissions are swirled by these horizontal air movements. It is therefore not possible to extract a large part of the emissions completely.

It is known from the prior art, to shield the region upstream of the coke oven retorts against side winds along the master gangways. The published document WO 2007/025638 A1 describes a coke oven operating machine with a cleaning device for a coke oven retort frame. Two wind protection walls are provided on the coke oven operating machine, which walls are arranged transversely to the master gangway. A shielding region against horizontal air movements is formed between the wind protection walls, along the master gangway. The wind protection walls shield a larger region upstream of the coke oven retorts in this case and stretch from the front of the coke oven operating machine, over the master gangway to the anchor stands of the coke oven or to the front of the coke oven retort. However, they exhibit a certain spacing from the floor of the master gangway as well as from the anchor stands or the front of the coke oven retort, so that the shielded region is not completely protected from the air movements along the master gangway. Furthermore, the wind protection walls do not take into account the fact that air movements through the open coke oven retorts are also disadvantageous for a complete capture and extraction of the emissions arising.

SUMMARY OF THE INVENTION

Against this technological background, the object of the invention is to specify a cleaning device for the frame of a coke oven retort which device guarantees a complete capture and extraction of the emissions arising during cleaning of the coke oven retort frame.

This object is solved according to the invention, in that the sealing elements are secured to the reverse side of the tool carrier, which side faces away from the coke oven retort, the sealing elements being orientated vertically and completely covering the height of the reverse side, in that the sealing elements consist of at least one central piece which is immovably fixed to the tool carrier as well as of side wings, the side wings being connected with the central piece in such a manner as to be rotationally moveable on vertical axes, and in that the side wings are moveable with an adjusting movement in the direction of the coke oven retort against the front surfaces of the anchor stands.

As a result of the adjusting movement, the sealing elements, the side wings of which rest against the front surfaces of the anchor stands, form a coke oven retort antechamber which is shielded against horizontal air movements, as, on the one hand, they use the anchor stands of the coke oven retorts as protection against air movements along the master gangways and, on the other hand, they catch the air movements through the open coke oven retorts and completely cover the height of the tool carrier. As a result of this complete sealing of the coke oven retort antechamber, the emissions arising during the cleaning of the frame are captured and can be conducted away from the coke oven region. It is only the coke oven retort antechamber and therefore the region in which the cleaning emissions arise which is shielded, as the tool carrier with the cleaning apparatuses for the frame is located with the coke oven retort inside the shielded region. Furthermore, the sealing elements do not extend into the region of the master gangways, so that this region remains clear for the operating personnel to carry out other tasks and/or work steps.

In a preferred configuration of the invention, the side wings can be moved with an adjusting movement of the tool carrier against the front surfaces of the anchor stands. As soon as the tool carrier is located in its working position upstream of the coke oven retort, the coke oven retort antechamber is sealed.

In a further preferred configuration of the invention, the side wings are assigned adjusting apparatuses in order to move the side wings with a separate adjusting movement about the vertical axes against the front surfaces of the anchor stands. In this manner, the side wings can subsequently also be moved against the front surfaces of the anchor stands, if the tool carrier is already located in its working position. As a result, the basic "sealing position" can be produced on the one hand, so that the side wings rest against the front surfaces of the anchor stands. On the other hand, an unsatisfactory "sealing position" can subsequently be corrected, if the side wings do not or incompletely rest against the front surfaces of the anchor stands.

It is expedient, that the side wings in each case exhibit an end which is bent over in the direction of the front surfaces of the anchor stands and with which the side wings rest against the front surfaces. As a result of the small contact surface produced between anchor stands and side wings, a higher contact pressure can be transmitted, so that the sealing is improved. Furthermore, for example, unevenness caused by coke or dust deposits on the front surfaces can be compensated, as the small contact surface of the bent over end rests better against the front surfaces than, for example, a broad contact surface of a flat sealing plate.

A preferred embodiment of the invention provides that side wings are assigned press-down devices, as a result of the action of which, the side wings rest against the front surfaces. The adjusting or press-down devices create an additional sealing force, so that an improved sealing action exists between the side wings and the front surfaces of the anchor stands. Preferably, the adjusting or press-down devices are elastic springs or hydraulic cylinders. An improved sealing action can be achieved as a result of the spring constants of the springs or as a result of the force of the hydraulic cylinders, by means of a precisely adjusted specific sealing force.

In the context of a particularly preferred embodiment of the invention, the central piece is U-shaped, the central piece exhibiting a central web orientated parallel to the oven retort as well as legs which are connected with the central web. The side wings are rotatably mounted on the ends of the legs. With this rotatable mounting, the side wings cover the pivoting range required for the separate adjusting movement. The U-shaped central piece is located in the region between the anchor stands, when the tool carrier is moved forward in its working position for the purpose of cleaning the coke oven retort frame. In this manner, the region to be sealed, in which the cleaning emissions arise, is further reduced in size. The space upstream of the coke oven retort is covered as well as possible with regard to a complete and optimal capture of the cleaning emissions.

The tool carrier can exhibit at least one device, preferably a scraper, for mechanically cleaning deposits on the coke oven retort frame. It is understood that other cleaning apparatuses, such as, e.g. high-pressure water jetting nozzles, can also be provided. These cleaning apparatuses are fundamentally known to a person skilled in the art from the prior art.

An extraction apparatus can be arranged above the tool carrier. The extraction apparatus covers the sealed region, that is to say the coke oven retort antechamber between the anchor stands upstream of the coke oven door, and its extraction power is adjusted to the quantity of cleaning emissions arising in this region. As the cleaning emissions arising can be captured completely using the device according to the invention, an installation of extraction powers which may be excessive can be avoided. In addition, it is understood that the device according to the invention can be arranged on both sides of the coke oven battery, both on the side of the coke ejection machine and on the side of the coke transfer machine.

BRIEF DESCRIPTION OF THE DRAWING

In the text that follows, the invention is explained with the aid of a drawing which represents solely one exemplary embodiment.

The single FIGURE shows, in a schematic representation, a horizontal section through a cleaning device according to the invention for the frame of a coke oven retort.

DETAILED DESCRIPTION OF THE PREFERRED EMBODIMENTS

The basic structure of the device illustrated in the FIGURE comprises a tool carrier 1 which can be positioned between anchor stands 2 of a coke oven retort 3 and exhibits cleaning apparatuses 4 for the frame 5 of the coke oven retort 3, as well as sheet-shaped sealing elements 6 which are arranged on the tool carrier 1. It can be taken from the FIGURE that the sealing elements 6 are secured to the reverse side of the tool carrier 1, which side faces away from the coke oven retort 3. The sealing elements 6 are orientated vertically and completely cover the height of the reverse side of the tool carrier. The FIGURE further shows that the sealing elements 6 consist of at least one central piece 7 which is immovably fixed to the tool carrier 1 as well as of side wings 8. One can see that the side wings 8 are connected with the central piece 7 in such a manner as to be rotationally moveable on vertical axes 9. The side wings 8 are moveable with an adjusting movement in the direction of the coke oven retort 3 against the front surfaces 10 of the anchor stands 2. As a result of the adjusting movement, the sealing elements 6 together with the front surfaces 10 of the anchor stands 2, against which surfaces the sealing elements rest with their side wings 8, form a coke oven retort antechamber which is shielded against horizontal air movements. On the one hand, the device according to the invention uses the anchor stands 2 of the coke oven retorts 3 as protection against air movements. On the other hand, the sealing elements 6, which are secured to the reverse side of the tool carrier 1, catch the air movements which come about as a result of the open coke oven retorts 3. The FIGURE makes it clear that it is exclusively the coke oven retort antechamber and therefore only the region in which cleaning emissions arise which is shielded. In this case, the tool carrier 1 with the cleaning apparatuses 4 for the frame 5 is located inside this shielded region.

The side wings 8 can be moved with an adjusting movement of the tool carrier 1 against the front surfaces 10 of the anchor stands 2, as the cleaning device according to the invention is arranged on a coke oven operating machine which is normally moved upstream of the front of the coke oven battery. As soon as the tool carrier 1 has taken up its working position for cleaning the coke oven retort frame 5, the coke oven retort antechamber is sealed, as the side wings 8 now rest against the front surfaces 10 of the anchor stands 2.

Furthermore, the FIGURE shows that adjusting apparatuses 11 are assigned to the side wings 8. The side wings 8 can be moved with a separate adjusting movement about the vertical axes 9 against the front surfaces 10 of the anchor stands 2 by actuating the adjusting apparatuses 11. In this manner, the side wings 8 can subsequently also be moved against the anchor stands 2, if the tool carrier 1 is already located in its working position. On the one hand, a basic "sealing position" can be set, so that the side wings 8 rest against the front surfaces 10 of the anchor stands 2. On the other hand, an unsatisfactory "sealing position" can also be corrected with this separate adjusting movement in the event that the side wings 8 do not or incompletely rest against the front surfaces 10 of the anchor stands 2.

The side wings 8 in each case exhibit an end 12 which is bent over in the direction of the front surfaces 10 of the anchor stands 2, as is likewise to be taken from the FIGURE. They rest against the front surfaces 10 with the end 12 which is bent over. It is to be recognised that in this manner, only a small contact surface is produced between the anchor stands 2 and the side wings 8. The sealing force brought about by the adjusting movement is transmitted optimally, via this small contact surface, from the side wings 8 to the front surfaces 10 of the anchor stands 2. Unevenness caused by deposits on the front surfaces 10 can be compensated as well as possible by means of this configuration of the side wings 8.

As likewise illustrated in the FIGURE, the side wings 8 are assigned press-down devices 13, as a result of the action of which, the side wings 8 rest against the front surfaces 10. These press-down devices 13 apply an additional sealing force. The sealing action improved in this manner enables optimal shielding against side winds and complete capture of emissions which arise during cleaning of the oven retort frame. In the illustrated exemplary embodiment, the press-down devices 13 are configured as hydraulic cylinders. With the aid of the hydraulic cylinder, a precisely adjusted specific sealing force can be applied to the side wings 8, so that an optimal sealing action can be achieved.

It is likewise illustrated in the FIGURE that the side wings 8 can be orientated parallel to the front surfaces 10 of the anchor stands 2, by means of the adjusting movement. In this manner, it is guaranteed that the side wings 8 do not rest against the front surfaces 10 in a skewed or tilted fashion, so that optimal shielding against turbulence from side winds is possible. Furthermore, an unintentional escape of emissions from the shielded region is prevented.

One can see from the FIGURE that the central piece 7 is U-shaped. The central piece 7 exhibits a central web 14, orientated parallel to the oven retort 3, as well as legs 15 which are connected with the central web. The side wings 8 are rotatably mounted on the ends of these legs 15. As a result of this design configuration, the central piece 7 is located in the region between the anchor stands 2, when the tool carrier 1 is located in its working position for the purpose of cleaning the coke oven retort frame 5. As a result of this configuration, a reduction in size of the region to be sealed is achieved. The pivotability of the side wings 8 for the separate adjusting movement is ensured by means of the vertical axes 9 of the pivot joints.

In the illustrated exemplary embodiment, the tool carrier 1 exhibits a scraper 16 as the only device for mechanically cleaning deposits on the coke oven retort frame. It is understood that, in addition to the cleaning device 4 illustrated, other cleaning devices 4 can also be provided. These devices 4 are known from the prior art and may be high-pressure water jetting nozzles, for example.

An extraction apparatus is arranged above the tool carrier 1, which apparatus is not illustrated in the FIGURE. The extraction apparatus completely covers the sealed region of the coke oven retort antechamber between the anchor stands 2, the coke oven retort front and also the front of the tool carrier 1 and may be configured as an extraction hood known from the prior art. As a result of the precisely delimited region of the coke oven retort antechamber, the installation of excessive extraction power can be avoided. The cleaning device according to the invention can be arranged on both sides of the coke oven battery, both on the side of the coke ejection machine and on the side of the coke transfer machine.

The invention claimed is:

1. A coke oven frame cleaning device for the frame of a coke oven retort with a tool carrier which can be positioned between anchor stands of the coke oven retort and exhibits cleaning apparatuses for the frame of the coke oven retort, sheet-shaped sealing elements being arranged on the tool carrier, wherein the sealing elements are secured to the reverse side of the tool carrier, which side faces away from the coke oven retort, the sealing elements being orientated vertically and completely covering the height of the reverse side, wherein the sealing elements consist of at least one central piece which is immovably fixed to the tool carrier as well as of side wings, the side wings being connected with the central piece in such a manner as to be rotationally moveable on vertical axes, and wherein the side wings are moveable with an adjusting movement in the direction of the coke oven retort against the front surfaces of the anchor stands.

2. The coke oven frame cleaning device according to claim 1, wherein the side wings can be moved with an adjusting movement of the tool carrier against the front surfaces of the anchor stands.

3. The coke oven frame cleaning device according to claim 1, wherein the side wings are assigned adjusting apparatuses in order to move the side wings with a separate adjusting movement about the vertical axes against the front surfaces of the anchor stands.

4. The coke oven frame cleaning device according to claim 1, wherein the side wings in each case exhibit an end which is bent over in the direction of the front surfaces of the anchor stands and with which the side wings rest against the front surfaces.

5. The coke oven frame cleaning device according to claim 1, wherein the side wings comprises press-down devices and rest against the front surfaces of the tool carrier.

6. The coke oven frame cleaning device according to claim 5, wherein the press-down devices are springs or hydraulic cylinders.

7. The coke oven frame cleaning device according to claim 1, wherein the central piece is U-shaped, the central piece exhibiting a central web orientated parallel to the oven retort as well as legs which are connected with the central web, and wherein the side wings are rotatably mounted on the ends of the legs.

8. The coke oven frame cleaning device according to claim 1, wherein the tool carrier includes at least one device for mechanically cleaning deposits on the coke oven retort frame.

9. The coke oven frame cleaning device according to claim 1, further comprising an extraction apparatus arranged above the tool carrier.

* * * * *